United States Patent [19]

Allen et al.

[11] Patent Number: 4,907,355

[45] Date of Patent: Mar. 13, 1990

[54] CYCLING SHOE WITH ADJUSTABLE CLEAT SYSTEM

[75] Inventors: Thomas P. Allen; Lawrence P. Eisenbach, both of Beaverton, Oreg.

[73] Assignees: Nike, Inc; Nike International Ltd., both of Beaverton, Oreg.

[21] Appl. No.: 220,323

[22] Filed: Jul. 18, 1988

[51] Int. Cl.[4] ..... A43B 5/14

[52] U.S. Cl. ..... 36/131; 36/132; 74/594.6

[58] Field of Search ..... 36/131, 62, 59 B, 132; 74/594.6, 594.4

[56] References Cited

U.S. PATENT DOCUMENTS

| | | | |
|---|---|---|---|
| 383,133 | 5/1888 | Kingston et al. . | |
| 550,409 | 11/1895 | Hanson | 74/594.6 |
| 598,325 | 2/1898 | McIntyre | 36/131 X |
| 1,232,896 | 7/1917 | Clifford . | |
| 3,354,561 | 11/1967 | Cameron . | |
| 3,672,077 | 6/1972 | Coles | 36/59 B |
| 3,707,047 | 12/1972 | Nedwick . | |
| 3,757,437 | 9/1973 | Cameron . | |
| 4,188,737 | 2/1980 | Haver | 36/131 |
| 4,298,210 | 11/1981 | Lotteau et al. | 36/131 X |
| 4,377,952 | 3/1983 | Gamondes | 74/594.6 |
| 4,449,308 | 5/1984 | Schar | 36/131 |
| 4,506,463 | 3/1985 | Chassaing | 36/131 |
| 4,538,480 | 9/1985 | Trindle | 36/131 X |
| 4,739,564 | 4/1988 | Eser | 36/131 |

FOREIGN PATENT DOCUMENTS

| | | | |
|---|---|---|---|
| 2240102 | 2/1974 | Fed. Rep. of Germany | 36/131 |
| 3135345 | 9/1981 | Fed. Rep. of Germany | 36/131 |
| 3414971 | 10/1985 | Fed. Rep. of Germany | 36/131 |
| 2427800 | 1/1980 | France | 36/131 |
| 2577767 | 8/1986 | France | 36/31 |
| 2058690 | 4/1981 | United Kingdom | 36/131 |
| WO87/07119 | 12/1987 | World Int. Prop. O. | 36/131 |

*Primary Examiner*—James Kee Chi

*Attorney, Agent, or Firm*—Banner, Birch, McKie & Beckett

[57] ABSTRACT

A cycling shoe with a convertible and adjustable cleat system is disclosed. The shoe includes and upper and a sole. A first removable disc has an outer surface formed of a material markable by contact with a bicycle pedal wherein the outer surface can be left with a mark indicative of the longitudinal and angular pedal position with respect to the shoe sole of the cyclist wearing the shoe. A second removable disc has an outer surface defining a cleat with a plurality of spaced grooves for engaging the pedal of a bicycle. A mechanism is provided for removably attaching the first and second discs to the sole in a plurality of rotational positions wherein the grooves of the second cleat are alignable in the angular position with respect to the sole as indicated on the markable material on the outer surface of the first disc. The present invention is also directed to a method for securing and aligning a pedal engaging cleat to a cycling shoe.

20 Claims, 2 Drawing Sheets

CYCLING SHOE WITH ADJUSTABLE CLEAT SYSTEM

TECHNICAL FIELD

The present invention relates to a cycling shoe and a method of attaching a cleat to the shoe. More particularly, the present invention relates to a cycling shoe with an improved cleat system or assembly. The cleat system is convertible between a recreational use level and a high-performance level. The cleat system, in the high-performance level is also adjustable to accommodate the pedal engaging cleat to the particular cyclist.

BACKGROUND OF THE INVENTION

Cycling shoes are currently designed to meet different and specific performance levels. Accommodating these different performance levels generally results in designing a shoe with compromises between comfort and performance. When a shoe is designed primarily for a touring or commuter cyclist, wherein the cyclist is willing to give up a degree of high-level performance for the sake of comfort, the shoe sole generally includes a rubber or rubber like outsole to provide support and traction during walking, and generally does not include a large pedal-engaging, adjustable cleat. On the other hand, when a high-level of cycling performance is desired, the shoe outsole is generally made of a very rigid plastic material and a relatively large pedal-engaging adjustable cleat is incorporated into the outsole. Such high-level performance cycling shoes offer very little, if any, comfort during walking, but provide positive engagement between the shoes and the bicycle pedals.

One technique to improve the comfort of performance style cycling shoes has been to incorporate a stiff shank into the insole while using a rubber or rubber like material for the outsole. Such a construction, however, limits the manner in which pedal-engaging cleats can be attached to the sole structure. In general, the higher performance level cycling shoes with adjustable cleats have used rigid plastic outsoles in order to provide a sturdy base for adjustably attaching the cleats.

The higher performance level cycling shoes with adjustable cleats, while providing the cyclist with a high level of pedal engagement capability, suffer certain drawbacks. For example, such cycling shoes generally are cumbersome, difficult to walk in, and adjustments in the positioning of the cleats is time consuming and difficult, and generally requires the use of tools. For example, West German Patent Specification No. 2,240,102 to Limberger discloses a bicycle racing shoe wherein the sole is made of a synthetic thermoplastic material and a grooved cleat is adjustably inserted within a recess in the plastic sole. Tabs extending around the recess are used to hold the cleat in position in the recess. In order to adequately hold the cleat within the recess, the plastic used in the Limberger shoe appears to be very rigid in order to provide sufficient strength to the tabs. Nevertheless, it appears that such a construction for holding the cleat to the sole would not provide sufficient resistance to rotation so that the cleat would rotate or pivot at times when the firm positioning of the groove and the cleat is required.

U.S. Pat. No. 4,377,952 to Gamondes also discloses a cycling shoe with a pedal-engaging cleat which is adjustably attached to the shoe outsole. Incremental angular adjustability is provided by mating teeth between a first and a second disc, while longitudinal adjustability is provided by interengaging teeth on the opposite side of the second disc and a third element. Once a desired angular and longitudinal position is selected, the three elements are locked in position by a set screw. However, a trial and error process must be used in order to find the desired cleat position. A cyclist estimates the cleat position and secures the cleat in place by tightening the set screw. Thereafter, the cyclist rides the bicycle to determine how the shoes feel. If the alignment of the cleat does not feel proper, the cyclist must loosen the set screw and readjust the discs to a position believed to be better. Thereafter, the cyclist must again ride the bicycle to see how the shoe feels. This process continues until the cyclist feels the cleat is in a proper position. Such a trial and error process is both time consuming and inaccurate.

U.S. Pat. No. 4,298,210 to Lotteau et al. discloses another technique for achieving a positive engagement between a pedal and a cycling shoe. In the '210 patent, a specially designed block is attached to a pedal and fits within a specially designed recess in an outsole.

The present invention was developed to alleviate the above disadvantages of prior art cycling shoes. That is, the present invention was developed to provide a cycling shoe which could have its chracteristics converted between those adapted for touring/commuting and high-level performance, and which uses a simpler and more accurate method and structure for attaching and orientating a pedal-engaging cleat on a shoe outsole.

SUMMARY OF THE INVENTION

The present invention is directed to a cycling shoe with a convertible and adjustable cleat system. The shoe has an upper and a sole. A first removable disc has an inner sole facing surface and an outer ground facing surface. The outer surface is formed of a material markable by contact with a bicycle pedal wherein the outer surface can be left with a mark indicative of the longitudinal and angular pedal position with respect to the shoe sole of the cyclist wearing the shoe. A second removable disc has a inner sole facing surface and outer ground facing surface. The second disc outer surface has a plurality of spaced grooves for engaging a pedal of a bicycle. A mechanism is provided for removably attaching the first and second discs to the sole in a plurality of rotational positions so that the grooves of the second cleat are alignable in the angular position with respect to the sole as indicated on the markable material of the outer surface of the first disc.

The invention is also directed to a method for aligning and securing a grooved pedal engaging cleat/disc to the sole of a cycling shoe and includes the steps of: securing a removable first disc to the sole of each of a pair of shoes with a markable outer surface of the first disc facing the ground; pedaling the bicycle while wearing the shoes until the markable outer surface is left with mark indicative of the position of the pedals with respect to the soles; marking the shoes in alignment with the marks on the outer surfaces of the first discs; removing the first discs from the soles; and securing second discs to the soles with a groove in the second discs in substantially parallel alignment with the marks placed on the shoes.

Another aspect of the invention is directed to the manner in which the grooves are formed in the disc surface. A first plurality of grooves are arranged in a longitudinally spaced, parallel relationship to one another and a second set of longitudinally spaced, parallel grooves are arranged transverse, preferably perpendicular, to the first grooves. Using two sets of grooves transversely orientated to one another allow a greater number of groove locations to be incorporated into the limited space on a pedal engaging disc.

Another aspect of the invention is directed to the structure used to connect the discs to the outsole. Specifically, mating hook and loop type material is used to removably attach the discs to the outsole. The use of such material has the advantage of allowing infinite rotational adjustability and also allows attaching and removing the discs, without the use of tools.

The present invention thus accomplishes both convertability between desired performance levels, and simplified cleat adjustability. Since the shoe uses a rigid-molded insole, the shoe provides efficient transfer of forces to the pedal, minimizing energy loss and foot discomfort. The rubber outsole provides a slip-resistant material under foot for secure walking comfort. When a lower level of performance is desired for example, for commuting purposes, the flat rubber disc is attached in a recess in the outsole using a hook and loop fastener. However, when a higher level of performance is desired, the rubber disc can be replaced with the grooved disc. The rubber disc can be used as a template to properly position the grooves of the other disc. This alleviates the need of the trial and error adjustment technique used in prior art cycling shoes.

Furthermore, the shoe is more comfortable to walk in with the grooved cleat attached than typical high-level performance cycling shoes, since such shoes generally have larger projecting cleats and support structure incorporated into a slick outsole base. A cycling shoe according to the present invention thus does not sacrifice walking ability for high-level performance capability.

Various additional advantages and features of novelty which characterize the invention are further pointed out in the claims that follow. However, for a better understanding of the invention and its advantages, reference should be made to the accompanying drawings and descriptive matter which illustrate and describe a preferred embodiment of the invention.

DETAILED DESCRIPTION OF THE PREFERRED EMBODIMENT

Figure 1:
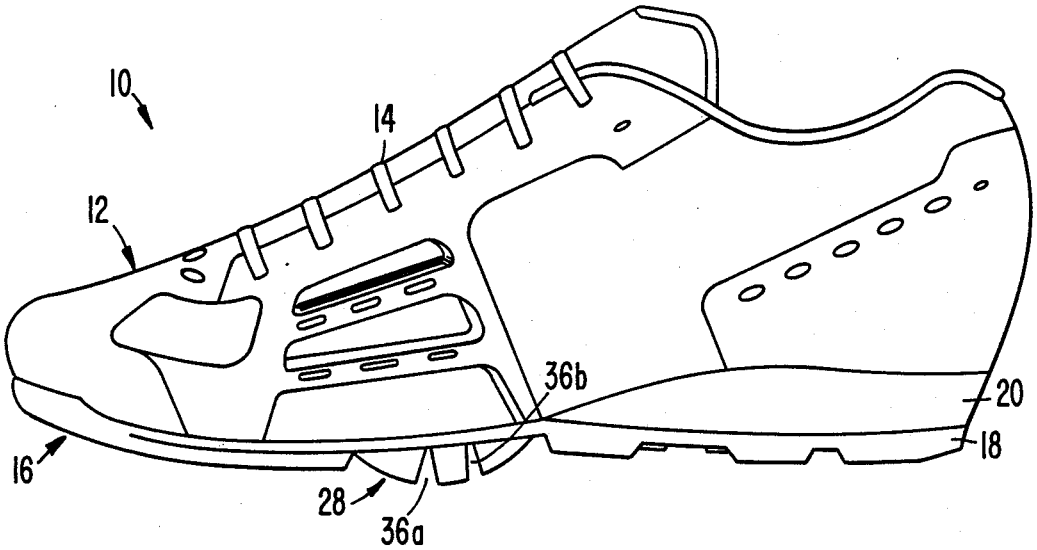
FIG. 1 is a lateral side view of a cycling shoe according to the present invention with a removable grooved disc attached to the outsole.

Referring to the drawings, wherein like numerals indicate like elements, there as shown in FIG. 1 a cycling shoe indicated generally as 10. Cycling shoe 10 includes an upper 12, which is secured to a wearer's foot by conventional lacing 14, and a sole 16 attached to upper 12. Sole 16 has several layers including an outsole 18, a heel wedge 20, and an insole plate 22.

Outsole 18 is formed of a relatively high friction material, such as solid rubber or a rubber like material, preferably with a specific gravity in the range of 1.16 to 1.18 and a Shore A hardness of 82 to 88. Outsole 18 has a typical thickness of 2.5 mm. Heel wedge 20 is located in the heel and arch area of shoe 10 and has its thickest portion under the heel and gradually tapers through the arch area. Wedge 20 is formed of a relatively cushioning material, preferably EVA having a specific gravity between 0.16 and 0.20, with an Asker C hardness of between 49 and 55. At its thickest portion, wedge 20 is typically 9 mm thick. Insole plate 22 is formed of a relatively stiff or rigid material, which is more rigid than outsole 18. The material for insole plate 22 is preferably nylon 6 with 30% glass fiber reinforcement, with a thickness varying between 2.5 mm and 3.5 mm.

A cushioning sock liner 24 is inserted within upper 12 on top of sole 16. Sock liner 24 is preferably formed of a polyethylene EVA with a specific gravity between 0.16 and 0.20 and an Asker C hardness between 42 and 48, with a thickness of 3.5 mm. The multi-layered construction of sole 16 adapts the shoe to the frequently competing objectives of comfort and performance. The rubber outsole provides shoe 10 with traction for walking, and forming heel wedge 20 of a cushioning material provides a degree of comfort during walking. Relatively stiff or rigid insole plate 22 allows shoe 10 to efficiently transfer forces to the bicycle pedal, thereby minimizing energy loss. Furthermore, foot discomfort is minimized because pedal pressure is dispersed through the rigid insole plate.

Shoe 10 includes a convertible and adjustable cleat assembly. The cleat assembly includes a first cleat or disc 26, a second cleat or disc 28 and a mechanism 30 for removably securing discs 26 and 28, one at a time, to the ground facing surface of outsole 18. The terms discs and cleats will be used interchangeably herein to indicate elements which can be incorporated into the outsole in the area where the outsole engages a bicycle pedal.

Figure 2:
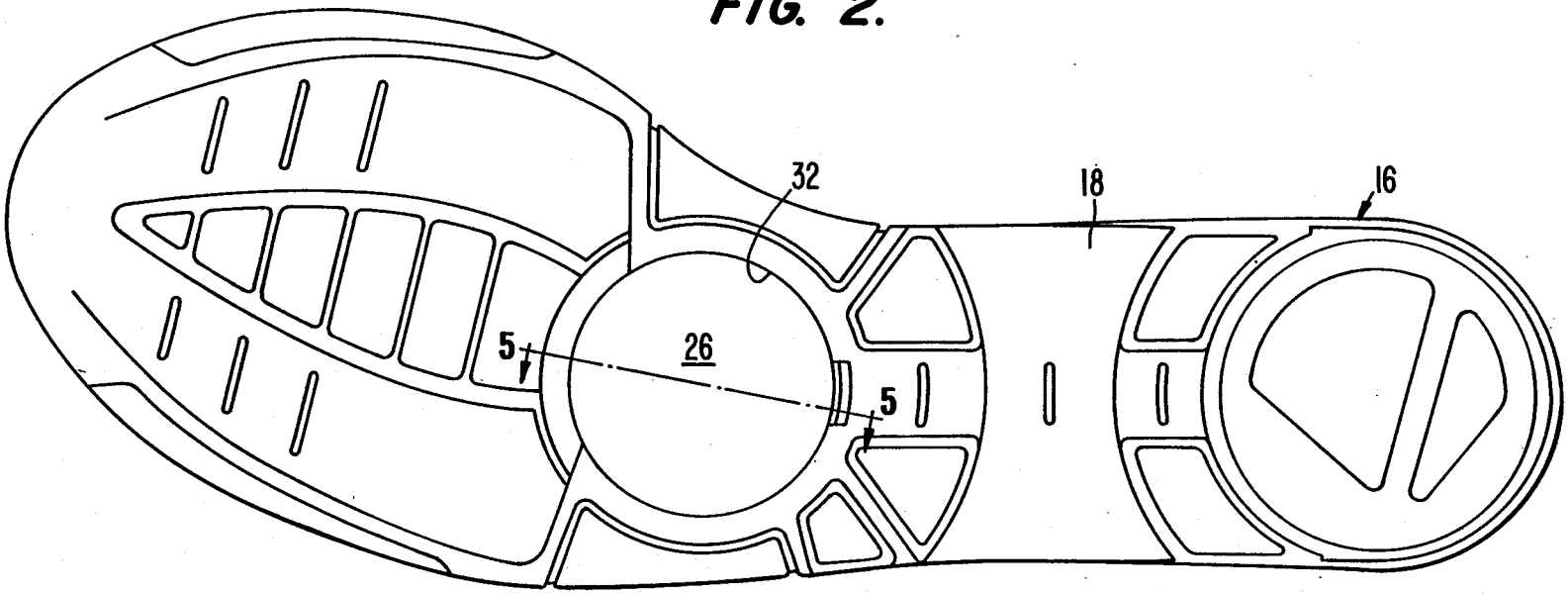
FIG. 2 is a bottom plan view of the outsole of the cycling shoe in accordance with the present invention with a removable rubber disc attached to the outsole.
Figure 3:
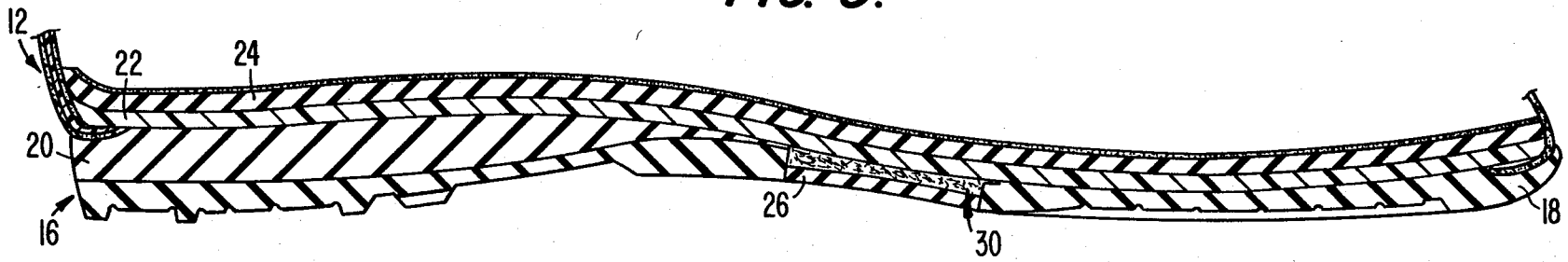
FIG. 3 is a longitudinal cross-sectional view through a portion of the shoe illustrated in FIG. 1 with a flat disc substituted for the grooved disc.

Details of first disc 26 are best seen in FIGS. 2 and 3. As seen therein, first disc 26 is substantially flat and has a circular perimeter. A circular recess 32 formed in the ground facing surface of outsole 18, and disc 26 is secured within recess 32. Mechanism 30 for securing disc 26 to outsole 18 is preferably formed of mating hook and loop fasteners 30a and 30b respectfully secured to disc 26 and outsole 18 within recess 32. Placing disc 26 within a recess performs the dual function of better holding disc 26 to outsole 18 and allowing the outer surface of disc 26 to lie flush with the surrounding area of outsole 18. Disc 26 is used when the cyclist does not want or need a high level of performance, which requires very positive engagement between the shoe and a bicycle pedal. For example, if the cyclist is using the bicycle for touring or commuting purposes, comfort during walking would take precedence over the performance during pedalling. Thus, the flat rubber disc 26, which is flush with the remainder of the outsole, would provide a greater degree of comfort during walking than second disc 28. Disc 26 can also perform an additional function of a template for properly aligning second disc 28.

Figure 4:
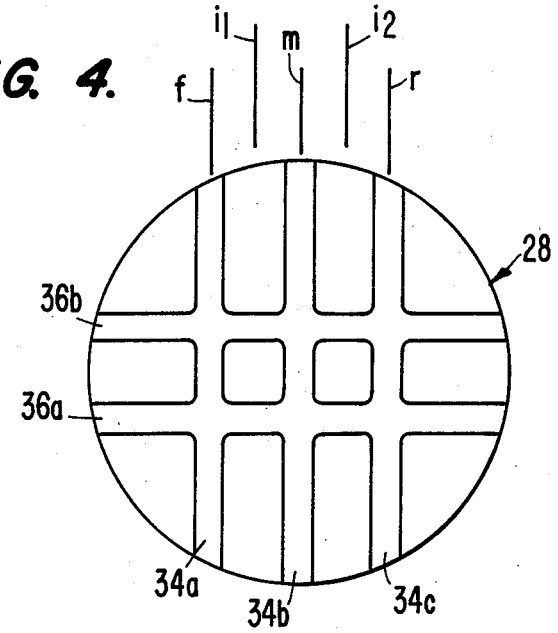
FIG. 4 is an enlarged plan view of the removable grooved disc with projection lines illustrating the alignment of all the grooves in the disc.
Figure 5:
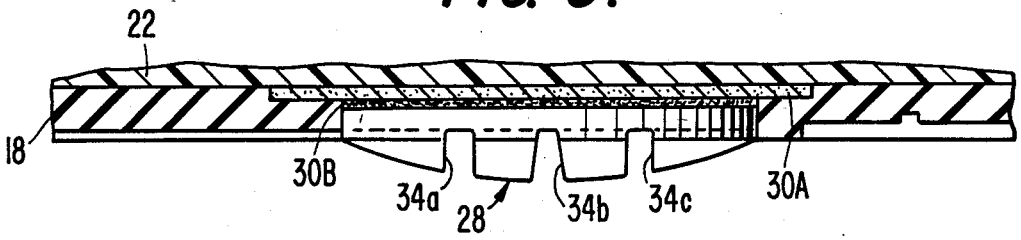
FIG. 5 is a cross-sectional view taken generally along line 5—5 of FIG. 2 with the grooved disc substituted for the flat disc.

As best seen in FIGS. 1, 4 and 5, second disc 28 has a generally circular perimeter, a flat inner facing surface to which either the hook or loop fastener is secured, and a generally curved or rounded ground facing surface. Disc 28 is formed of a relatively hard material, preferably a hard plastic such as a polyurethane with a specific gravity of between 1.22 and 1.24 and a Shore A hardness between 92 and 98. The maximum thickness of disc 28 is typically in the range of 7.5 to 7.55 mm.

A plurality of first grooves 34*a*, 34*b* and 34*c* are formed in the ground facing surface of disc 28 and are aligned in a spaced, generally parallel relationship to one another. A plurality of of second grooves 36*a* and 36*b* are formed in the ground facing surface of disc 28, also in a spaced, parallel relationship to one another. Second grooves 36 are orientated transverse, preferably perpendicular, to first grooves 34. The use of two sets of grooves transverse to one another allows the grooves to be located at a greater number of longitudinal positions along the length of sole 16 than if the grooves were formed in a single direction. FIG. 4 includes projection lines from cleat 28 which indicate the longitudinal locations along with the sole that the grooves 34 and 36 would occupy when aligned in position along outsole 18, e.g., perpendicular to the length of the sole. As seen therein first grooves 34*a*, 34*b* and 34*c* would align at forward "f", middle "m" and rear "r" locations, while second grooves 36*a* and 36*b* would align at intermediate locations "$i_1$" and "$i_2$" between the forward and middle, and the rearward and middle locations respectfully. Due to space limitations within disc 26, such a large number of grooves could not be formed in a single direction, since there could be insufficient material surrounding the grooves to assure the strength required to maintain the walls of the grooves. Since hook and loop fasteners 30a and 30*b* are used to removably fasten disc 28 to outsole 18, grooves 34 or 36 can be aligned in any angular position with respect to the axis of the shoe sole.

First disc 26 is used as a template in the following manner to properly align grooves 34 or 36 of second disc 28 in the proper longitudinal and angular position. A flat disc 26 is secured to outsole 18 within recess 32 of both shoes 10. The cyclist thereafter pedals for a distance sufficient to mark the pedal location on first discs 26. To this end, discs 26 are formed of, or with an outer surface of, a markable material. Typically, the flat discs are formed of the same rubber or rubber like material as outsole 18. Riding several miles with the flat discs is generally sufficient for the pedal cage to leave an impression or mark across discs 26. Thereafter, outsoles 18 are marked in alignment with the mark or impression on discs 26, and discs 26 are removed. A second disc or cleat 28 is thereafter located adjacent each circular recess 32 and rotated to select one of the first or second grooves 34 or 36 which best aligns longitudinally along the length of outsole 18. The selected groove is also rotated to be placed in parallel alignment with the mark on the respective outsole indicative of the pedal cage location of the particular cyclist. Cleats 28 are then secured within recesses 32 of outsoles 18 in the aligned position. Again, the hook and loop fastener 30 allows for a precise alignment at any angular position, and the use of this fastener in combination with the circular recess 32 assures a secure attachment of cleat 28 to outsole 18. This securement and alignment system permits quick and simple alignment and securement of the pedal engaging cleat, and does away with the typical prior art trial and error method of aligning a cleat to a cycling shoe.

Numerous characteristics and advantages of the invention have been described in detail in the foregoing description with the accompanying drawings. However, the disclosure is illustrative only and the invention is not limited to the precise illustrated embodiment. Various changes and modifications may be effected herein by one skill in the art without departing from the scope and spirit of the invention.

We claim:

1. A cycling shoe and a convertible and adjustable cleat system comprising:

a shoe having an upper and a sole; and a cleat assembly including a first disc, a second disc, and means for attaching said discs to said sole;

said first removable disc having an inner sole facing surface and an outer ground facing surface, said outer surface being formed of a material markable by contact with a bicycle pedal wherein the outer surface can be left with a mark indicative of the longitudinal and angular pedal position with respect to the shoe sole of the cyclist wearing the shoe;

said second removable disc having an inner sole facing surface and an outer ground facing surface, said second disc outer surface having at least one groove for engaging a pedal of a bicycle;

said attaching means removably attaching, one at a time, said first and second discs to said sole in a plurality of rotational positions wherein said groove of said second cleat is alignable in the angular position with respect to said sole as indicated on the markable material on the outer surface of said first disc.

2. A cycling shoe and cleat system in accordance with claim 1 wherein a plurality of said at least one groove are formed in said second disc outer surface.

3. A cycling shoe and cleat system in accordance with claim 2 wherein said plurality of grooves in said second disc include a plurality of first spaced parallel grooves and a plurality of second spaced parallel grooves disposed transverse to said first grooves.

4. A cycling shoe and cleat system in accordance with claim 1, 2 or 3 wherein said sole includes a recess in its outer surface and at least a portion of said first and second discs is received in said recess when a respective one of said discs is attached to said sole.

5. A cycling shoe and cleat system in accordance with claim 4 wherein said recess in said sole is circular and said first and second discs include a portion with a circular perimeter.

6. A cycling shoe and cleat system in accordance with claim 5 wherein said means for removably attaching said discs to said sole include hook and loop fasteners.

7. A cycling shoe and cleat system in accordance with claims 1 or 2 wherein said means for removably attaching said discs to said sole include hook and loop fasteners.

8. A cycling shoe and cleat system in accordance with claim 1 or 2 wherein said sole includes an outsole formed of a relatively high friction rubber or rubber-like material.

9. A cycling shoe and cleat system in accordance with claim 8 wherein said sole further includes an insole portion formed of a material more rigid than the outsole material.

10. A cycling shoe with an angularly and longitudinally adjustable cleat comprising:

a shoe having an upper and a sole;

a cleat having an inner sole facing surface and an outer ground facing surface; and means for attaching said cleat to said sole in a plurality of rotational positions;

said outer surface of said cleat having a plurality of first grooves arranged in a generally parallel, spaced relationship to one another and a plurality of second grooves arranged in a generally parallel, spaced relationship to one another, said first grooves being orientated transverse to said second grooves, said first and second grooves occupying different locations along the length of the sole when the respective grooves are orientated perpendicular to the length of the sole to maximize adjustability of said shoe and cleat system within the limited cleat area.

11. A cycling shoe with an adjustable cleat in accordance with claim 10 wherein said first and second grooves are oriented perpendicular to one another.

12. A cycling shoe with an adjustable cleat in accordance with claim 10 or 11 wherein said attaching means removably attaches said cleat to said outsole.

13. A cycling shoe with an adjustable cleat in accordance with claim 12 including another cleat removably attachable to said outsole by said attaching means, said other cleat being substantially flat and having an outer surface formed of a material markable by contact with a bicycle pedal wherein the outer surface can be left with a mark indicative of the longitudinal and angular pedal position with respect to the shoe of the cyclist wearing the shoe.

14. A cycling shoe with an adjustable cleat in accordance with claim 12 wherein said attaching means includes hook and loop fasteners.

15. A method for aligning and securing a grooved pedalengaging cleat/disc to the sole of a cycling shoe including the steps of:

(a) securing a removable first disc to the sole of each of a pair of shoes with a markable outer surface of the first disc facing the ground;

(b) pedalling a bicycle while wearing the shoes until the markable outer surfaces are left with marks indicative of the position of the pedals with respect to the soles;

(c) marking the shoes in alignment with the marks on the outer surfaces of the first discs;

(d) removing the first discs from the soles; and (e) securing second discs to the soles with a groove in the second discs in substantially parallel alignment with the marks placed on the shoes.

16. A method in accordance with claim 15 wherein the second discs include a plurality of first spaced parallel grooves and a plurality of second spaced parallel grooves disposed transverse to the first grooves, and the second discs are secured to the soles with the closest groove from the first or second set in alignment with the marks placed on the shoes.

17. A cycling shoe and adjustable cleat system comprising:

a shoe having an upper and a sole; and a cleat assembly including a disc and means for attaching said disc to said sole;

said disc having an inner sole facing surface and an outer ground facing surface, said disc outer surface having at least two sets of grooves wherein each groove is capable of engaging a pedal of a bicycle, wherein each said set comprising at least one groove, one said set of said at least two sets of grooves being disposed transverse to the other said set to maximize the adjustability of said shoe and cleat system within the limited cleat area; and said attaching means removably attaching said disc to said sole in a plurality of rotational positions wherein said at least one groove of one said set is alignable in the angular position with respect to said sole.

18. A cycling shoe and adjustable cleat system in accordance with claim 17 wherein one set of said at least two sets of grooves comprises a plurality of spaced parallel grooves.

19. A cycling shoe and adjustable cleat system in accordance with claim 17 wherein said at least two sets of grooves consist of two sets of grooves.

20. A cycling shoe and adjustable cleat system in accordance with claim 17 wherein each set of said at least two sets of grooves consists of a plurality of parallel spaced grooves.

* * * * *